US009169061B2

(12) United States Patent
Blanchard et al.

(10) Patent No.: US 9,169,061 B2
(45) Date of Patent: Oct. 27, 2015

(54) CONTAINMENT BAG

(75) Inventors: Korey W. Blanchard, Covington, LA (US); Michael L. Nottley, Sombra (CA)

(73) Assignee: HQN Industrial Fabrics, Inc., Corunna (CA), by said Michael L. Nottley ( * ) Notice: Subject to any disclaimer, the term of this patent is extended or adjusted under 35 U.S.C. 154(b) by 720 days.

(21) Appl. No.: 13/261,125

(22) PCT Filed: Jul. 7, 2010

(86) PCT No.: PCT/US2010/001914

§ 371 (c)(1),
(2), (4) Date: Jan. 6, 2012

(87) PCT Pub. No.: WO2011/005315

PCT Pub. Date: Jan. 13, 2011

(65) Prior Publication Data

US 2012/0106872 A1 May 3, 2012

Related U.S. Application Data

(60) Provisional application No. 61/270,417, filed on Jul. 8, 2009.

(51) Int. Cl.
*B65D 88/16* (2006.01)
*B65D 90/04* (2006.01)

(52) U.S. Cl.
CPC ..... *B65D 88/1618* (2013.01); *B65D 90/046* (2013.01); *B65D 2590/046* (2013.01)

(58) Field of Classification Search
CPC ..... B65D 88/1612; B65D 88/1618; B65D 88/1625; B65D 88/1631; B65D 88/1668; B65D 88/1681; B65D 88/1687; B65D 88/62; B65D 90/046; B65D 90/048; B65D 2313/02; B66C 1/226
USPC ..... 220/1.5–1.6, 9.1–9.3, 495.01, 220/495.05–495.06, 495.08–495.09; 383/2, 383/33, 61.1–61.5, 66, 88–89, 97–99
See application file for complete search history.

(56) References Cited

U.S. PATENT DOCUMENTS

| | | | | |
|---|---|---|---|---|
| 3,557,853 | A * | 1/1971 | Jones | 383/86 |
| 4,385,953 | A | 5/1983 | Beck | |
| 4,390,051 | A | 6/1983 | Cuthbertson | |
| 4,630,312 | A * | 12/1986 | Milstein | 383/86 |
| 4,988,216 | A * | 1/1991 | Lyman | 383/74 |
| 5,098,364 | A | 3/1992 | Schilling | |
| 5,110,005 | A * | 5/1992 | Schilling | 220/495.08 |

(Continued)

OTHER PUBLICATIONS

USPTO Patent Full-Text and Image Database, Search Results, ACLM/"and/or" hits 1-50 of 268,174, Jul. 9, 2015.

(Continued)

*Primary Examiner* — Bryon Gehman
*Assistant Examiner* — Brijesh V. Patel
(74) *Attorney, Agent, or Firm* — Christopher John Rudy

(57) ABSTRACT

Containment bag for an industrial container embraces a non-self-supporting container having a top, sides, and a bottom, which define an interior space; in at least one of the top and sides, at least one opening for introduction of material into the interior space; and for the at least one opening a flap that can be sealed at or beyond the at least one opening. Sealing is provided through at least one of a hook and loop closure system and an adhesive system. The bag can be employed with the industrial container.

22 Claims, 6 Drawing Sheets

(56) References Cited

U.S. PATENT DOCUMENTS

| | | | | |
|---|---|---|---|---|
| 6,132,088 | A * | 10/2000 | Suzuki | 383/23 |
| 6,155,772 | A * | 12/2000 | Beale | 414/607 |
| 6,250,488 | B1 * | 6/2001 | Narahara et al. | 220/1.6 |
| 7,073,676 | B1 * | 7/2006 | Town | 220/1.6 |
| 7,074,174 | B2 * | 7/2006 | Lindgren et al. | 588/249.5 |
| 7,320,411 | B1 * | 1/2008 | Shenosky et al. | 220/495.06 |
| 7,845,511 | B1 * | 12/2010 | Strickland et al. | 220/495.11 |
| 8,191,722 | B1 * | 6/2012 | Town | 220/1.6 |
| 8,209,995 | B2 * | 7/2012 | Kieling et al. | 62/457.1 |
| 2006/0193541 | A1 * | 8/2006 | Norcom | 383/200 |
| 2007/0127852 | A1 * | 6/2007 | Town et al. | 383/16 |
| 2007/0278225 | A1 * | 12/2007 | Van Romer | 220/9.4 |
| 2008/0031550 | A1 * | 2/2008 | Town et al. | 383/16 |
| 2009/0001089 | A1 * | 1/2009 | Britt et al. | 220/666 |
| 2009/0250460 | A1 * | 10/2009 | Chang | 220/9.4 |
| 2010/0111449 | A1 * | 5/2010 | Noble et al. | 383/22 |

OTHER PUBLICATIONS

USPTO Patent Full-Text and Image Database, Search Results, ACLM/"sea/land" hits 1-7 of 7, Jul. 9, 2015.

Webster's Ninth New Collegiate Dictionary, Merriam-Webster Inc., Springfield, Mass., 1984.

* cited by examiner

CONTAINMENT BAG

This claims priority benefits of provisional U.S. patent application No. 61/270,417 filed on Jul. 8, 2009 A.D. In the United States of America (US), the same is claimed pursuant to 35 USC 119(e); 363 and/or 365, and, where applicable, as in the US, the specification of that provisional patent application in its entirety, to include its drawings, is incorporated herein by reference.

FIELD OF THE INVENTION

This concerns a non-self-supporting bag for an industrial product/waste container.

BACKGROUND TO THE INVENTION

Various containment bags for waste containers are known. See, e.g., Town, U.S. Pat. No. 7,073,676 B1. As useful as such a bag may be it is not without drawbacks. In general, a bag having tie-off points is not well sealable, and a bag with a zipper closure can be subject to "single point" failure, and so forth. The following is further noted:

1. Prior tie-off configurations have a number of flaws, among which may be mentioned the following:
   - A. Multiple tie-off points leave spaces or gaps between the multiple closures of the bag. An effective seal can be difficult if not impossible to obtain.
   - B. If such a bag is overfilled, which happens in real world situations, it makes it hard, if not impossible, to close the bag.
2. Prior zipper and flap closure configurations have a number of flaws, among which may be mentioned the following:
   - A. If the zipper pull breaks or is pulled off the zipper, the bag is useless in the field. Containment bags are large, and a great amount of force is exerted on the zipper pull. Hence, a single point failure of a breaking zipper pull is not uncommon.
   - B. Most of such containment bags are used on waste clean-up sites where the bag is loaded with a lot of debris, dirt, and other industrial wastes. If even a small amount of dirt or debris, for example, gets into the zipper channel or mechanism, it can render the bag nearly if not entirely useless.
   - C. Sometimes zipper systems can get off-line. If it does so in the field, a big problem is created since the bag is rendered nearly if not entirely useless.
   - D. If such a bag is overfilled, again, which happens in real world situations, it makes it hard, if not impossible, to close this type of bag, too.

It would be desirable to ameliorate if not completely solve or overcome one or more of such drawbacks or flaws. It would be desirable to provide the art alternative(s).

A Full Disclosure of the Invention

Provided is a containment bag for an industrial container, which comprises a non-self-supporting container having a top, sides, and a bottom, which define an interior space; in at least one of the top and sides, at least one opening for introduction of material into the interior space; and for the at least one opening a flap that can be sealed at or beyond the at least one opening, wherein sealing is provided through at least one of a hook and loop closure system and an adhesive system. The bag can be employed in combination with the industrial container.

The invention is useful in management of product and/or waste materials.

Significantly, by the invention, the art is advanced in kind. One or more of the drawbacks or flaws of the art is or are ameliorated, solved or overcome, and the art is provided with alternative(s). More particularly, the present bag can be effectively well sealed, and it can effectively avoid single point failure. It can be easily installed in a container such as a dumpster. The present bag has the following particular advantages:

1. Versus prior tie-off configurations, among other advantages may be mentioned the following:
   - A. Reliance solely on multiple tie-off points from spaced apart tie-offs is avoided, and the present bag avoids spaces or gaps in sealing. An effective if not complete seal can be obtained hereby.
   - B. If the present bag is overfilled, as will happen in real world situations, its flap and closure system can enable ready closure of the bag.
2. Versus prior zipper and flap closure configurations, among other advantages may be mentioned the following:
   - A. The present bag can avoid the single point failure of zipper pull breaking or being pulled off the zipper, as a zipper can be avoided. Thus, the present bag is significantly more likely to maintain its utility in the field.
   - B. The present bag resists if not overcomes failure to seal from dirt or debris through its flap and sealing system, and can be effectively closed in situations where a zipper and flap closure configuration would fail to seal. Thus, clean-up work on hazardous waste clean-up sites can proceed apace, avoiding extremely costly failures that can cause such work to temporarily shut down.
   - C. A zipper can be avoided, thus avoiding problems from an off-line zipper.
   - D. If the present bag is overfilled, again, as will happen in the real world, its flap and closure system can enable ready closure of the bag.

Numerous further advantages attend the invention.

The drawings form part of the specification hereof. With respect to the drawings, which are not necessarily to scale, the following is briefly noted:

It has a sealing system of hook and loop material such as VELCRO® fastener, optionally an adhesive such as glue, around its upper perimeter, which is closed off utilizing the additional height of the bag, and sealed down the middle. Secondary reinforcement contrivances or auxiliary closures in a form of securable straps are also provided. Here, flap portions when sealing/sealed also form a top.

Figure 1:
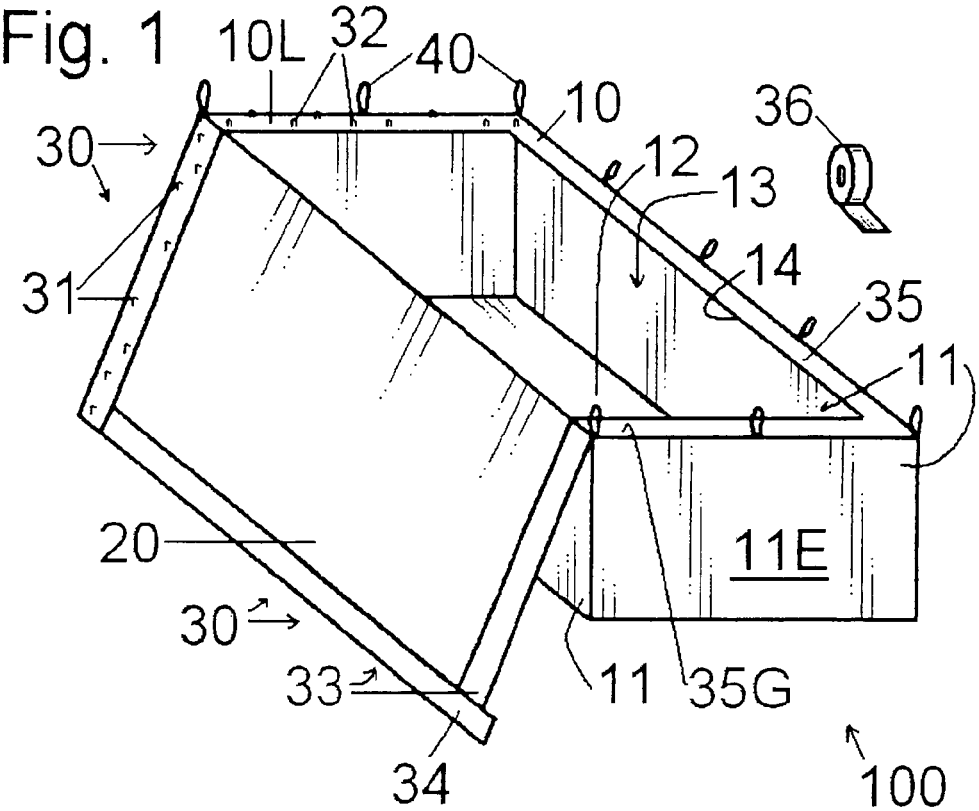
FIG. 1 is a perspective view of a containment bag hereof, which is top-loading.
Figure 2:
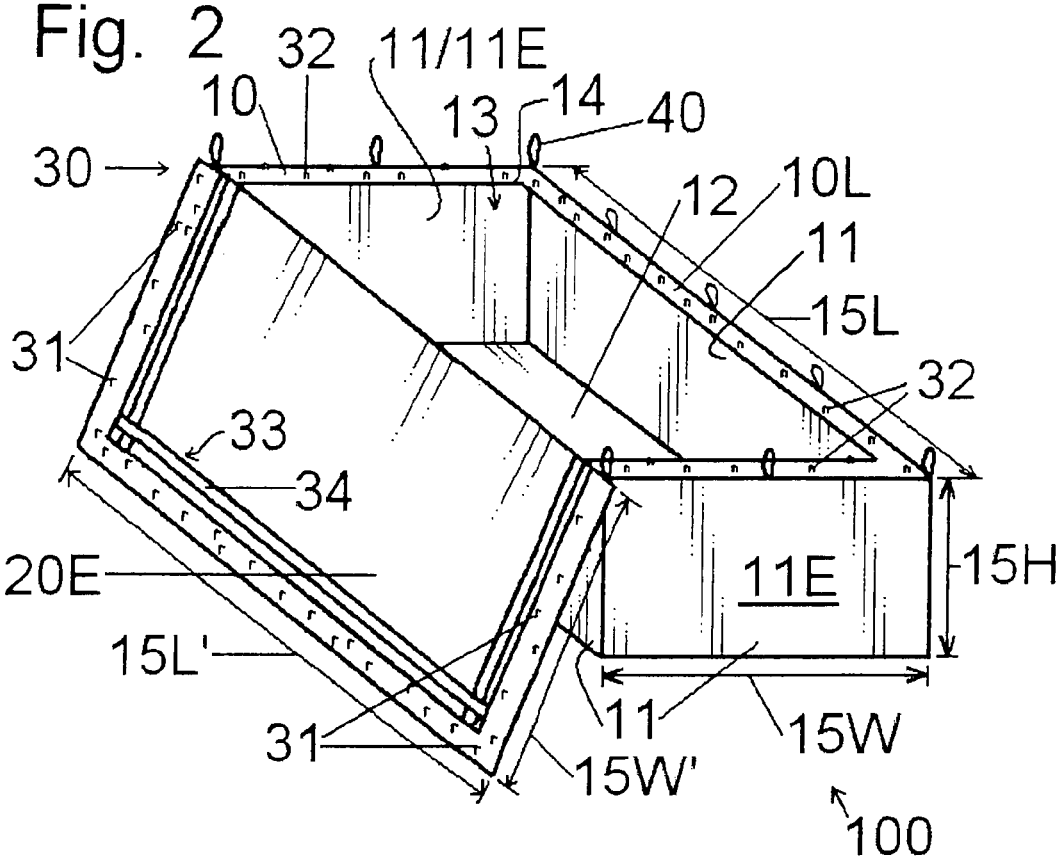
FIG. 2 is a perspective view of a containment bag hereof, which is top-loading and is further expandable through additional flap material in relation to the top of the bag.
Figure 3:
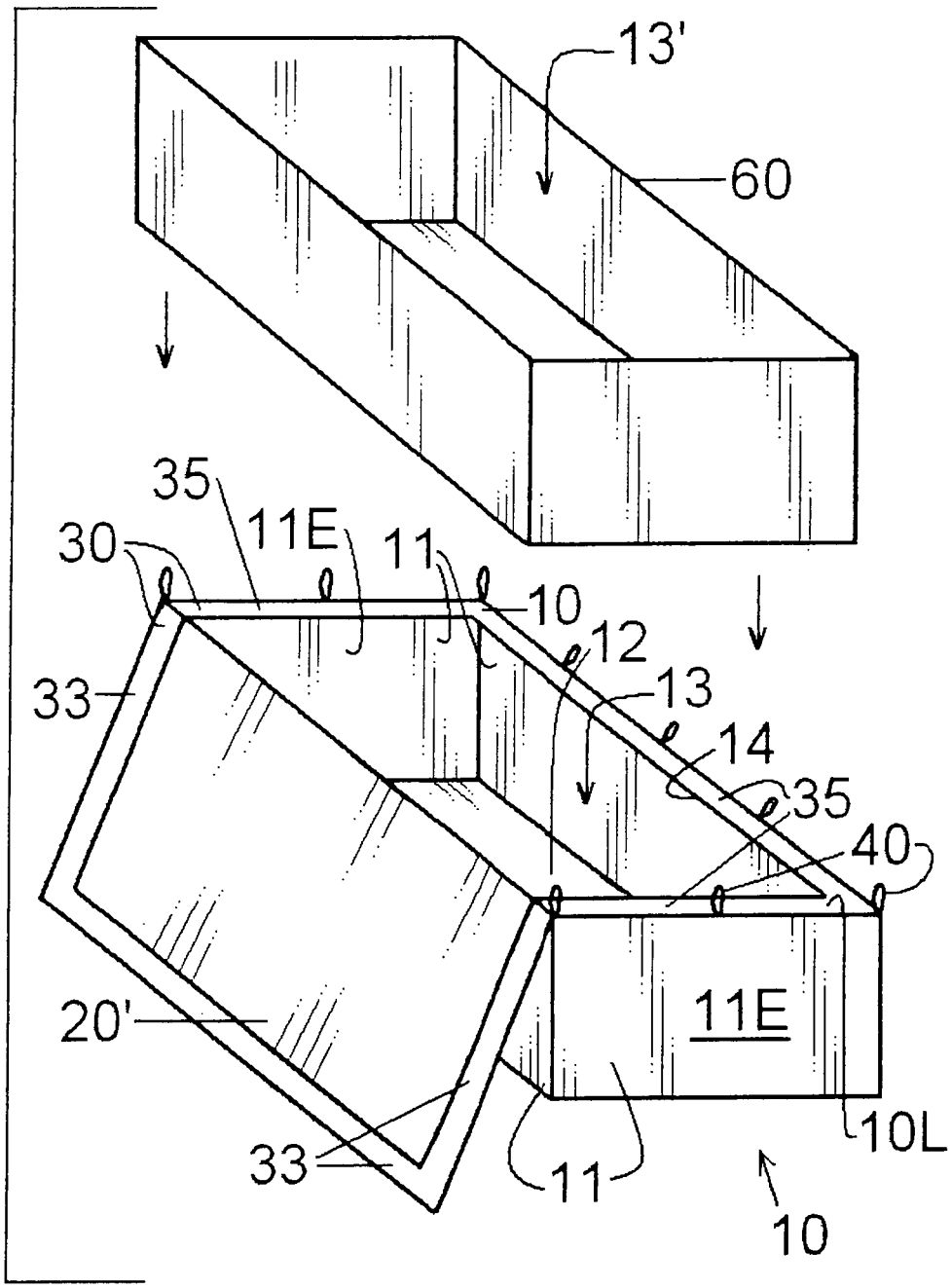
FIG. 3 is an exploded perspective view of a containment bag hereof, into which an inner liner bag is being inserted for installation.
Figure 4:
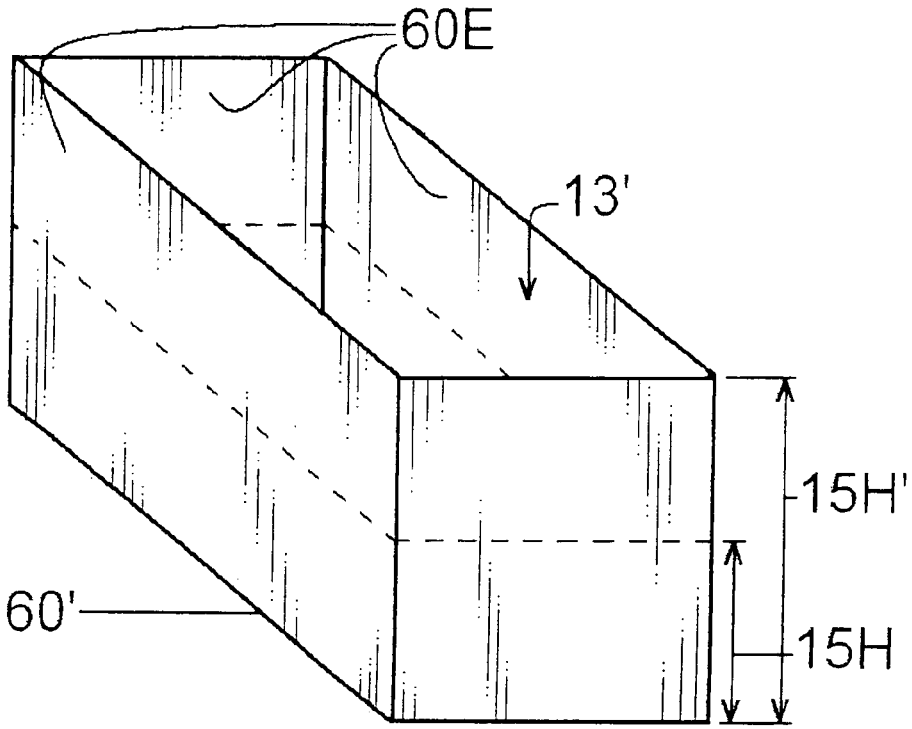
FIG. 4 is a perspective view of a tall inner liner bag for lining a containment bag hereof. The tall inner liner bag has extra height.
Figure 5:
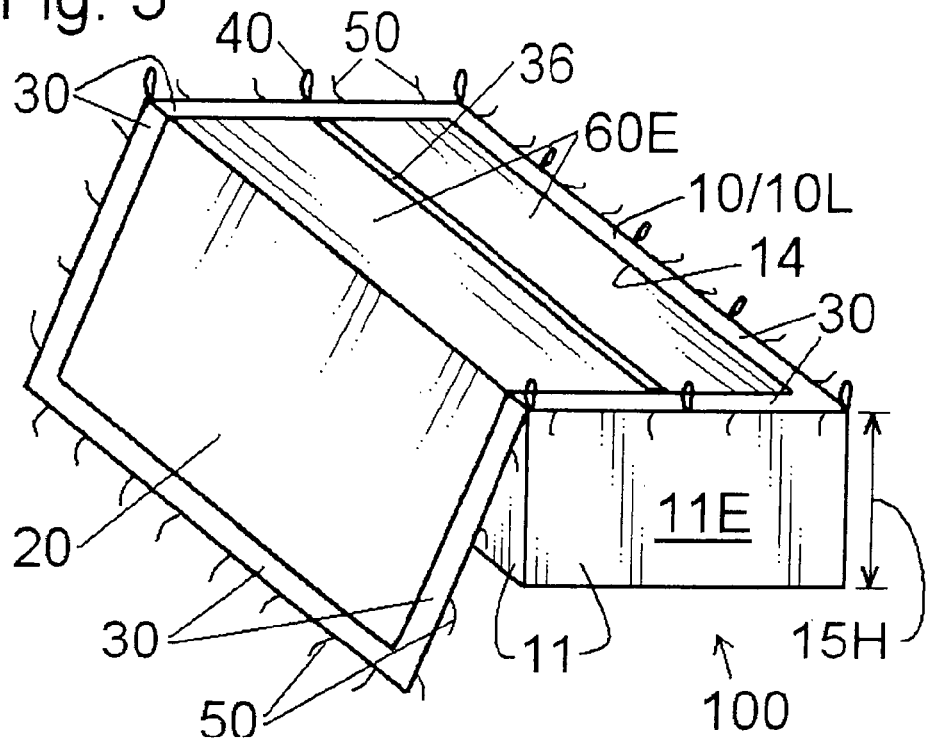
FIG. 5 is a perspective view of a containment bag hereof, into which the tall inner liner bag has been inserted, installed, and sealed inside the containment bag within which it resides.
Figure 6:
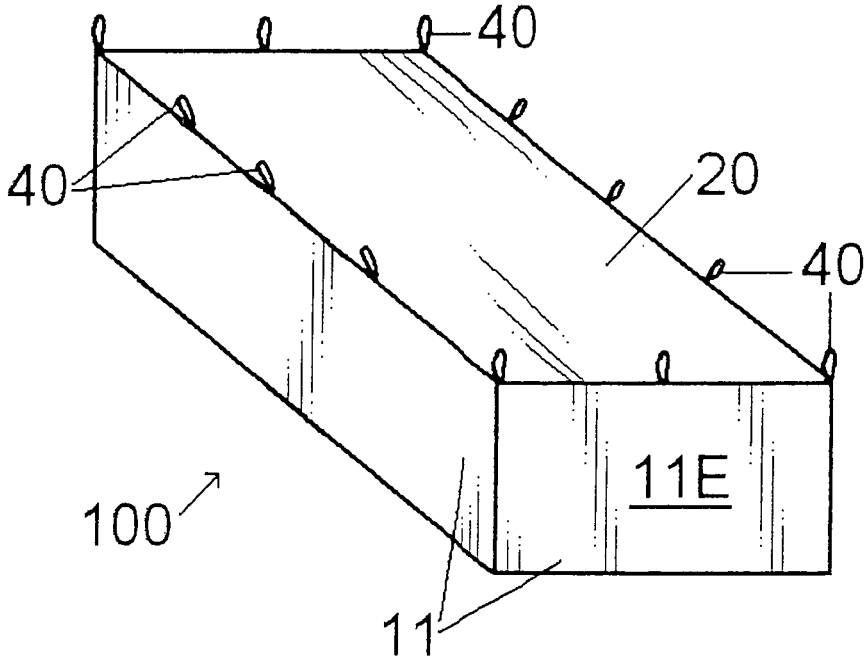
FIG. 6 is a perspective view of a containment bag as of FIG. 1, 2 or 3, sealed.
Figure 7:
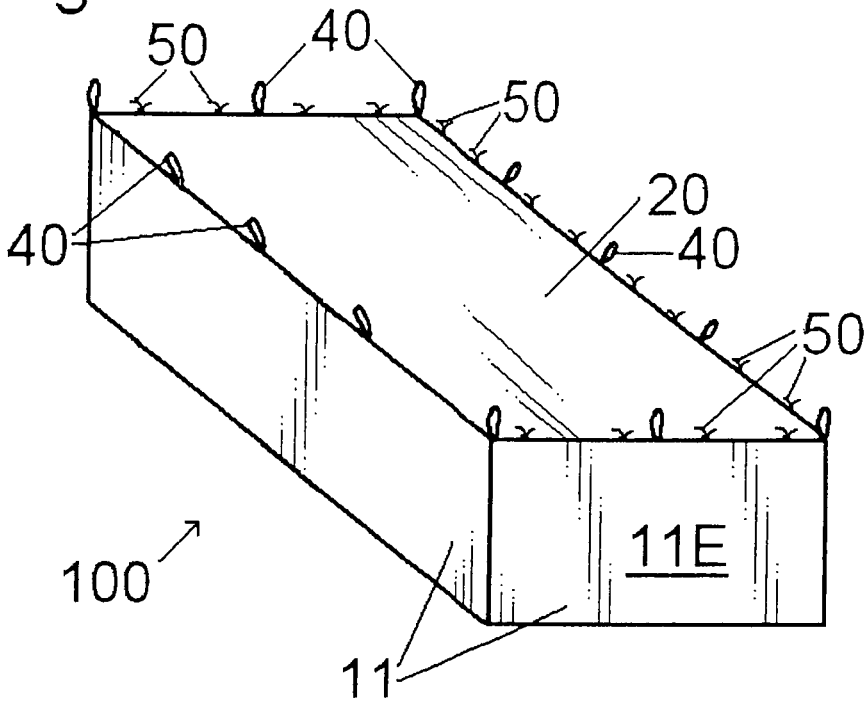
FIG. 7 is a perspective view of a containment bag as of FIG. 5, sealed, to include with employment of secondary reinforcement contrivances or auxiliary closures in a form of ties.
Figure 8:
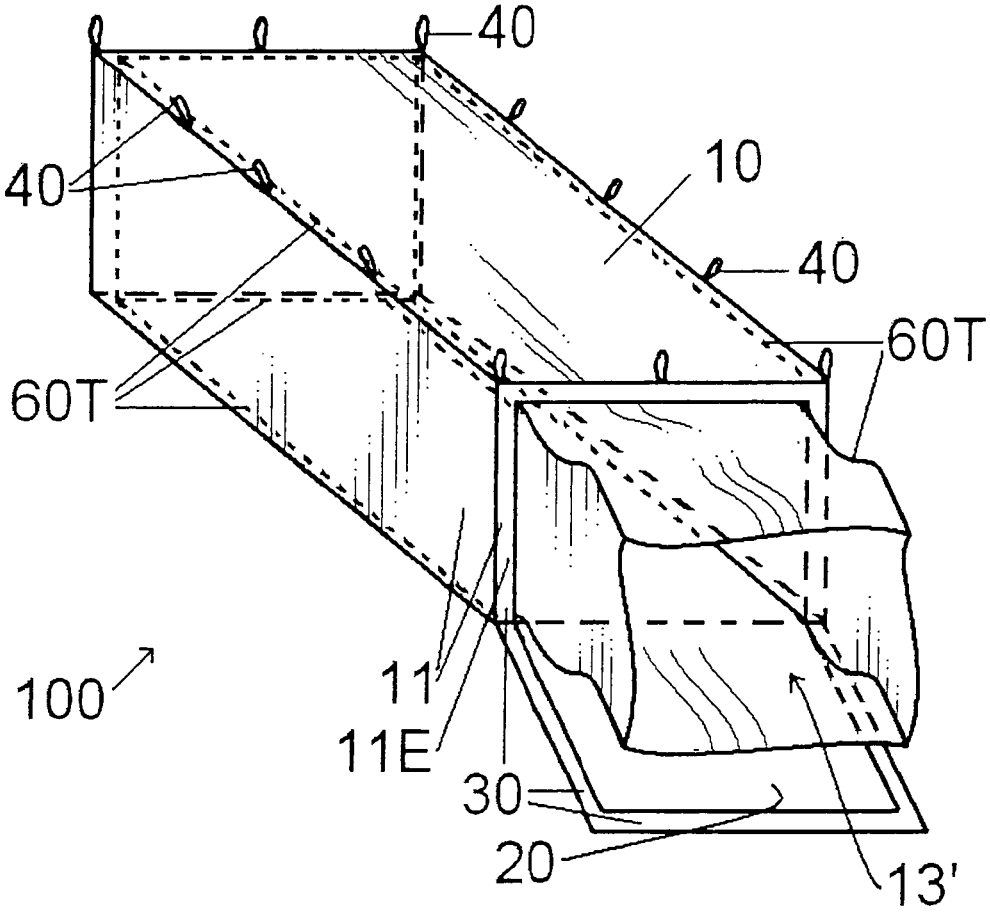
FIG. 8 is a perspective view of a containment bag hereof, which is side-loading. An optional inner liner is shown disposed therein.
Figure 9:
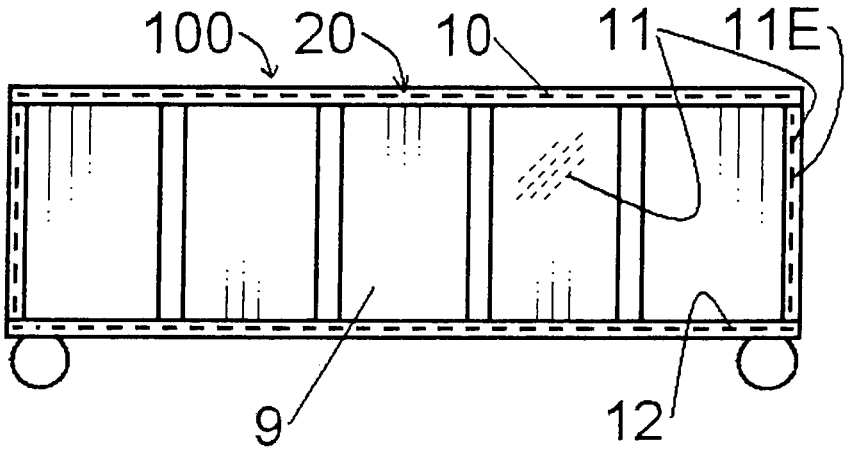
FIG. 9 is a side plan view of a containment bag hereof in an industrial container.
Figure 10:
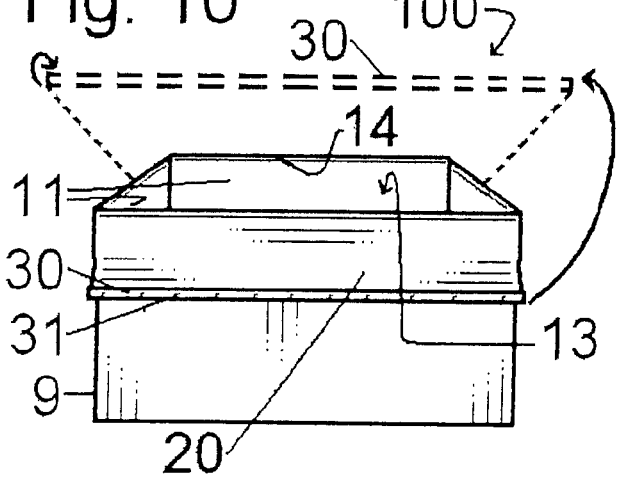
FIG. 10 is a perspective plan view of a top-loading containment bag hereof in an industrial container, ready for use.
Figure 11:
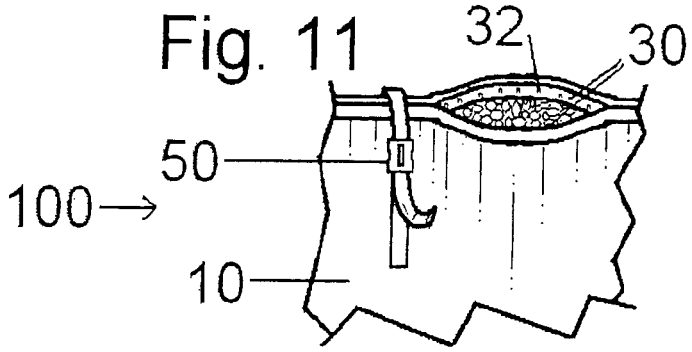

FIG. 11 is a perspective view of part of the bag of FIG. 10 being closed with the additional aid of a securable strap, which is being secured.

Figure 12:
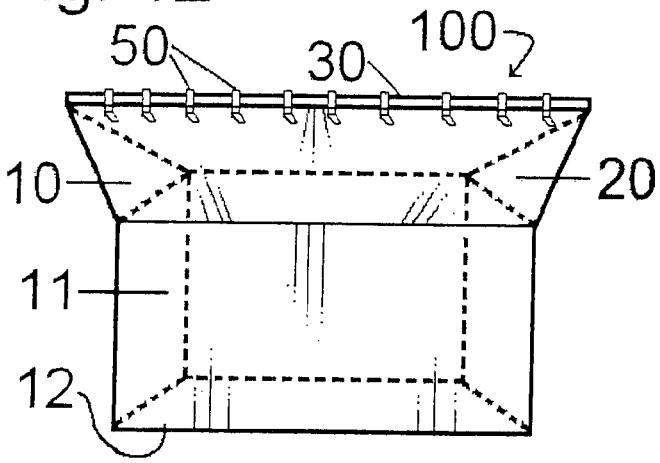

FIG. 12 is a perspective plan view of the bag itself within FIG. 10, sealed.

Figure 13:
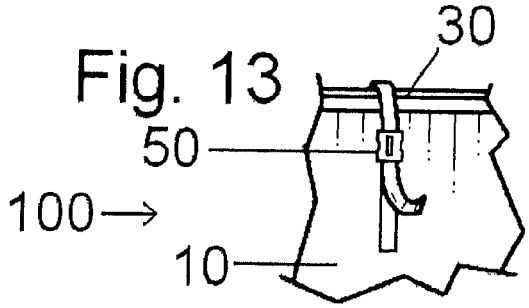

FIG. 13 is a perspective view of a part of the bag of FIG. 10, top-loaded and sealed with the additional aid of the securable strap.

The invention can be further understood by the detail set forth below, which may be read in view of the drawings. The same, as with the foregoing, is to be taken in an illustrative and not necessarily limiting sense.

The present containment bag is non-self-supporting and is for employment in an industrial container such as for products or wastes. Examples of such containers include, but are not limited to, those well known in the art such as roll-off dumpsters, and other dumpsters; end-dump trailers, dump trucks, and other hauling trailers; rail cars, rail gondolas; intermodal containers; sea/land style shipping or hauling containers; lugger boxes; and other waste containers. The bag has a sealable flap for its top and/or one or more of its sides, for example, an end. The bag flap is for completely sealing and avoiding single point failure, which is achieved by employing a hook and loop system such as VELCRO® fastener and/or an adhesive such as glue, which may be in tape form and may be covered by a protective paper covering for removal in the field to expose the glue as in peel-and-stick tapes. Traditional sealing expedients such as tie-offs, zippers and slides can be avoided; optionally, however, they may be employed as secondary reinforcement contrivances or auxiliary sealing expedients or closures. Optionally, too, secondary reinforcement contrivances or auxiliary sealing expedients or closures such as buckles, straps and/or clips may be employed. The present bag may have an inner liner.

The containment bag can be made of any suitable material. For instance, it may be a plastic such as of a polyolefin, for example, polyethylene (PE) and/or polypropylene (PP), which may be woven or non-woven, notably of woven PE and/or PP.

The containment bag can be employed in the industrial container by itself. As well, a liner, say, also in the form of a bag, inside the containment bag may be employed. More than one such inner liner may be employed per containment bag. Also, a separate containment bag may be employed as the inner liner. The containment bag can be used in wet or dry applications. The inner liner(s) assist(s) in handling liquids and providing further protection against leaks, and may be made of a blown film PE and/or PP, and so forth. The present bag, with or without liner, as may be appropriate, may be employed in transport and containment of industrial, chemical, nuclear and/or other hazardous waste materials, as the situation and ordinances may permit.

Further, with respect to the drawings, industrial container 9, for example, in a form of a dumpster, can be provided inside with containment bag 100. The containment bag 100 includes top 10; sides 11, which can include ends 11E; and bottom 12. The top 10 may provide for lip 10L. Interior space 13 is bounded thereby, and opening 14 is provided, for example, in the top 10 or an end 11E. The bag 100, or liner 60, 60', 60T, or parts thereof, may be generally rectangular, for example, and have height 15H, length 15L, and width 15W. Taller liner height 15H', and longer flap length 15L' and wider flap width 15W' may be provided, for example, in extra tall inner liners or in expandable bag configurations, respectively. For example, if the main bag 100 had an about 5-foot height 15H, the tall inner bag 60' could have a 10-foot height 15H' so that the additional five feet of material 60E could initially drape over the sides of the containment bag and industrial container 9; once filled, the extra height 60E of the inner liner 60' could meet, say, in the middle of the opening 14, and be sealed. Flap 20 can cover the opening 14, and may be part of the top 10 or side 11. Additional length 15L' and/or width 15W', say, about two inches (about five centimeters) or more for either or both of these dimensions, on a flap 20, 20' may provide for an expandable bag configuration. A double-layered flap 20' may be provided, for instance, where liquids are to be contained. Sealing system 30 is provided to seal the flap 20 at or beyond the opening 14, say, on that portion of the top 10 or side/end 11/11E that remains after provision of the opening 14 therein. The flap 20 may be provided with material spanning in excess of that needed to seal the opening 14 to provide for an expandable flap 20E, which, although it can cost more in material and/or workmanship to make a containment bag 100 with it, can accommodate overfilling in the field most readily. The sealing system 30 can be in a form of a hook 31 and loop 32 system in which the hook 31 and loop 32 portions are pressed against each other to seal the containment bag 100 and/or in a form of an adhesive system that may have glue 33 covered by release web 34 such as coated paper that is removed to expose the glue 33 so that the glue 33 can be pressed against an opposing sealable surface 35 to seal the containment bag 100. The sealable surface 35 may be itself provided with glue 35G or not. The hook 31 and loop 32 system can provide for reopening of the containment bag 100 for inspection if needed. The adhesive system with glue 33 can permanently seal the bag 100. Adhesive tape 36 such as from a roll may be used to seal the containment bag 100, which may be done in systems that are not inspected, or in systems that are inspected, before or after inspection.

Additional features and/or devices may be provided the containment bag 100. Lift loops 40 may be provided. Secondary reinforcement contrivances 50, which may be considered to be auxiliary sealing expedients or closures, such as ties, buckles, straps and/or clips, even magnets, can be strategically placed around the opening 14 and flap 20 sealing it, which can add another level of protection to the seal, which can be valuable, for example, when the containment bag 100 is loaded with waste materials and discharged from the industrial container 9 at a disposal site. As mentioned above, the inner liner 60 may be provided, which may be, for example, of an open-top variety of about the same height as the sides 11 of the containment bag 100, and sewn or tabbed in; or liner 60' may be taller than the sides of the containment bag 100, being provided with extra material 60E so that, when filled, there could be enough extra material 60E to be folded over and meet, say, in the middle, and be sealed. The latter provision could allow the containment bag 100 and inner liner 60' with extra material 60E together to be completely sealed twice so that if either would fail the other would be a back up, especially for liquids. An inner liner in a form of a tube 60T may be employed with end-flap systems. For instance, the tube liner 60T may have an about 26-foot or 27-foot (about eight or eight and one-third meter) length or so for stitching or tabbing in an about 22-foot (about six and three-fourths meter) long end-flap system containment bag 100. The inner liner 60, 60', 60T goes into the interior space 13 of a corresponding containment bag 100, and opens to its own interior space 13'

The present invention is thus provided. Various feature(s), part(s), step(s), subcombination(s) and/or combination(s) can be employed with or without reference to other feature(s), part(s), step(s), subcombination(s) and/or combination(s) in its practice, and numerous adaptations and modifications can be effected within its spirit, the literal claim scope of which is particularly pointed out as follows:

What is claimed is:

1. A containment bag for use in an industrial container having a plurality of sidewalls defining a top and bottom, the bottom being closed and the top being substantially open or able to be opened for accepting bulk materials, with the plurality of sidewalls and the bottom defining an industrial container interior, said containment bag comprising a non-self-supporting bag construction adapted and useful for fitting within and closely lining the industrial container interior with the industrial container supporting the containment bag, being filled with at least one of product material and waste material while fitting within and closely lining the industrial container interior, being sealed and transported in the industrial container after filling, and being dumped, not lifted, from the industrial container, wherein said bag construction has following features:

a bag top substantially alignable with the top of the industrial container, bag sides, and a bag bottom, which define an interior space of the bag construction, with the bag sides and the bag bottom not having openings or not having openings larger than those afforded by any woven material, when present, used to make at least one of the bag top, the bag sides and the bag bottom;

an opening in the bag top for introduction of the at least one of the product material and waste material into the interior space of the bag construction;

a flap as at least part of the bag top, made with a woven or nonwoven material, extending from one of the bag sides to provide a flap base and an extending web, the flap not having openings or not having openings larger than those afforded by any woven material, when present, used to make the flap, which can be sealed against another portion of the containment bag by a sealing system; and the sealing system, which:

includes at least one of a hook and loop system, and an adhesive system; and provides for sealing with the flap on its extending web.

2. The containment bag of claim 1, wherein the sealing system does not include a zipper.

3. The containment bag of claim 1, wherein the sealing system includes the hook and loop system but not the adhesive system.

4. The containment bag of claim 1, wherein the sealing system includes the adhesive system.

5. The containment bag of claim 4, wherein the adhesive system has a glue covered by a release web that is removed to expose the glue so that the glue can be pressed against an opposing sealable surface to seal the containment bag.

6. The containment bag of claim 1, wherein the sealing system includes the adhesive system but not the hook and loop system.

7. The containment bag of claim 1, wherein the sealing system includes both the hook and loop system and the adhesive system.

8. The containment bag of claim 1, wherein the bag top includes a lip, against which the extending web of the flap is sealed by the sealing system.

9. The containment bag of claim 1, wherein the bag top, including the flap, bag sides, and bag bottom are made of the woven or nonwoven material; and the flap extends in excess of that needed to seal the opening in the bag top to provide for an expandable flap, which can accommodate overfilling in the field.

10. The containment bag of claim 1, which has an elongate bag construction wherein the bag sides are provided as a first pair of opposing bag sides and a second pair of opposing bag sides, with the first pair of opposing bag sides extending horizontally substantially more than the second pair of opposing hag sides extend horizontally; and the flap extends from one of the first pair of opposing bag sides.

11. The containment bag of claim 10, which has a length at least twice its width or height.

12. The containment bag of claim 11, wherein the length is at least about 22 feet.

13. The containment bag of claim 1, wherein at least one of the following features (A, B) is present:

(A) at least one of a secondary reinforcement contrivance, and an auxiliary sealing expedient or closure; and (B) an inner liner.

14. The containment bag of claim 1, wherein an inner liner is present, which is an open top variety with sides taller than the sides of the containment bag.

15. In combination, the containment bag of claim 1 and the industrial container.

16. The combination of claim 15, wherein the industrial container is selected from the group consisting of a roll-off dumpster, another dumpster, an end-dump trailer, a dump truck, another hauling trailer, a rail car, a rail gondola, an intermodal container, a sea style shipping or hauling container, a land style shipping or hauling container, and a lugger box.

17. A containment bag for use in an industrial container having a plurality of sidewalls, a top and a bottom, with one of the sidewalls being substantially open or able to be opened for accepting bulk materials and the remaining sidewalls, the top and the bottom being closed to define a side-loading industrial container with a side opening, with the plurality of closed sidewalls, top and bottom defining an industrial container interior, said containment bag comprising a non-self-supporting bag construction adapted and useful for fitting within and closely lining the industrial container interior with the industrial container supporting the containment bag, being filled with at least one of product material and waste material while fitting within and closely lining the industrial container interior, being sealed and transported in the industrial container after filling, and being dumped from the industrial container, wherein said bag construction has following features:

a first bag side substantially alignable with the side opening of the industrial container, remaining bag sides, a bag top, and a bag bottom, which define an interior space of the bag construction, the remaining bag sides, the bag top, and the bag bottom not having openings or not having openings larger than those afforded by any woven material, when present, used to make at least one of the first bag side, the remaining bag sides, the bag top and the bag bottom;

an opening in the first bag side for introduction of the at least one of the product material and waste material into the interior space of the bag construction;

a flap as at least part of the first bag side, extending from one of the remaining bag sides, the bag top or the bag bottom to provide a flap base and an extending web, the flap not having openings or not having openings larger than those afforded by any woven material, when present, used to make the flap, which can be sealed against another portion of the containment bag by a sealing system; and the sealing system, which:

includes at least one of a hook and loop system, and an adhesive system; and provides for sealing with the flap on its extending web.

18. The containment bag of claim 17, wherein the sealing system does not include a zipper.

19. The containment bag of claim 17, wherein the first bag side is designated a first bag end; the remaining bag sides include two opposing elongate sides and a second bag end which opposes the first bag end; the first and second bag ends are connected to and are of substantially less area than that constituted by the two opposing elongate sides; the first bag end includes a lip, against which the extending web of the flap is sealed by the sealing system; and the sealing system includes the adhesive system, which has a glue covered by a release web that is removed to expose the glue so that the glue can be pressed against an opposing sealable surface to seal the containment bag.

20. In combination, the containment bag of claim 17 and the industrial container, wherein a liner is also provided in the containment bag.

21. A containment bag for use in an industrial container having a plurality of sidewalls defining a top and bottom, the bottom being closed and the top being substantially open or able to be opened for accepting bulk materials, with the plurality of sidewalls and the bottom defining an industrial container interior, said containment bag comprising a non-self-supporting bag construction adapted and useful for fitting within and closely lining the industrial container interior with the industrial container supporting the containment bag, being filled with at least one of product material and waste material while fitting within and closely lining the industrial container interior, being sealed and transported in the industrial container after filling, and being dumped, not lifted, from the industrial container, wherein said bag construction has following features:

bag sides, and a bag bottom, which define an interior space of the bag construction, the bag sides and the bag bottom not having openings or not having openings larger than those afforded by any woven material, when present, used to make at least one of the bag sides and the bag bottom;

a top opening for introduction of the at least one of the product material and waste material into the interior space of the bag construction;

a top closure web as part of the bag sides, made with a woven or nonwoven material, extending upward from the bag sides to provide top closure web bases and extending closure webs, the top closure web not having openings or not having openings larger than those afforded by any woven material, when present, used to make the top closure web, wherein the extending closure webs include opposing quadrilateral panel portions and opposing triangular panel portions opposing each other orthogonal to the opposition of the opposing quadrilateral panel portions when the opposing quadrilateral, panel portions are brought together along top portions thereof for sealing against one another to seal the containment bag by a sealing system about a center portion of the top closure web; and the sealing system, which:

includes at least one of a hook and loop system, and an adhesive system, but not a zipper; and provides for sealing with the top closure web along the top portions of the opposing quadrilateral panel portions of the extending closure webs.

22. In combination, the containment bag of claim 21 and the industrial container, wherein the sealing system of the containment bag includes the hook and loop system or the adhesive system but not both.

* * * * *